United States Patent [19]

Deger

[11] Patent Number: 4,790,536

[45] Date of Patent: Dec. 13, 1988

[54] PARALLEL COIL PIN BALL FLIPPER SOLENOID

[76] Inventor: Kurt W. Deger, 1163 E. Paddock Dr., Palatine, Ill. 60067

[21] Appl. No.: 151,633

[22] Filed: Feb. 2, 1988

[51] Int. Cl.[4] ..... A63F 7/26

[52] U.S. Cl. ..... 273/121 A; 273/129 V

[58] Field of Search ..... 273/121 A, 129 V

[56] References Cited

U.S. PATENT DOCUMENTS

| | | | |
|---|---|---|---|
| 4,384,716 | 5/1983 | Powers | 273/129 V |
| 4,542,905 | 9/1985 | Hooker | 273/121 A |
| 4,557,483 | 12/1985 | Kimura | 273/121 A |

FOREIGN PATENT DOCUMENTS

| | | | |
|---|---|---|---|
| 74937 | 7/1978 | Japan | 273/121 A |

*Primary Examiner*—Robert E. Garrett

*Assistant Examiner*—John T. Kwon

*Attorney, Agent, or Firm*—William T. Rifkin

[57] ABSTRACT

A dual-coil solenoid for actuating pin ball game flippers having a high actuation and ball propelling force and a lower flipper and ball holding force. The solenoid includes low and high resistance coils placed in electrically parallel relationship across a source of electrical energy upon actuation of a flipper switch by a game player. Upon full deflection of the flipper and solenoid, an end of stroke switch automatically removes electrical energy from the low resistance coil thereby leaving only the high resistance coil energized to hold the flipper and game ball in position. A capacitance is positioned across the end of stroke switch to absorb electrical energy from the low resistance coil and to protect the switch. Diodes further protect both switch and the capacitor from excessive voltage transients.

5 Claims, 2 Drawing Sheets

PARALLEL COIL PIN BALL FLIPPER SOLENOID

The present invention relates to an electromechanical solenoid apparatus with particular application as a 'flipper' actuator in a pin ball game.

As is well known within the pin ball game art, flippers are pivotally-mounted members positioned within the game play field to enable players to contact, hold, and/or redirect steel game balls while in-play on the game playing field. A flipper must be capable of delivering sufficient force to propel a steel ball under dynamic conditions, that is, while both the ball and flipper are in motion as well as, alternatively, being able to merely support the ball under static conditions. In this latter "static" state, the flipper is activated or energized, but neither the flipper nor ball are in motion.

It will be appreciated that these extreme game play conditions afford an unusual range of required loading on the solenoid actuated flipper. Typically, only one-tenth of the dynamic propelling power is required to maintain the flipper/ball combination in its actuated, but quiescent state.

Various schemes have been proposed to lower the power delivered to a flipper solenoid immediately following actuation. Indeed, failure to lower the power or current through the flipper solenoid may result in solenoid overheating and ultimate failure.

One such scheme is the placement of a simple resistance in series with the solenoid to limit the current, in the conventional manner, through the solenoid as the solenoid completes its actuation stroke. This arrangement, while protecting the solenoid against overheating, is very inefficient as the series resistance merely dissipates energy as heat without providing a corresponding useful work function.

Another known arrangement is a series connection of high resistance "holding" and low resistance "switching" solenoid coils such as shown in FIG. 1. During the dynamic, high-force actuation portion of the flipper cycle, the high resistance winding, $N_h$, is by-passed by an 'end-of-stroke' ("EOS") switch. Consequently, the entire supply voltage is impressed across the low resistance winding, $N_s$, resulting in a relatively large switching current, therethrough. As the solenoid and flipper reach the stroke limit position, the EOS switch opens, placing both the high and low current solenoid coils, $N_s$ and $N_h$, in series.

The series configured flipper actuated solenoid is advantageous in that the power delivered to the high resistance winding $N_h$, contributes useful magnetomotive force to retain the solenoid in its activated position. Thus, the energy supplied is not entirely dissipated as occurs with the series resistance arrangement discussed above.

However, this series coil configuration suffers several significant limitations. First, the sudden placement of a high resistance, and therefore high inductance, coil in series with the low resistance winding results in a corresponding instantaneous switching of the current, from the EOS switch through the high resistance winding, $N_h$. Since the voltage induced across any inductance is directly proportional to the rate of change of the current therethrough, this sudden switching of the high current, through the high inductance of $N_h$ necessarily results in the generation of extremely large, and potentially damaging, voltage transient across the high resistance coil.

Such voltages may cause the break-down of inter-winding insulation of the high resistance coil as well as place significant strain on the EOS switch which must, at the very least, absorb the energy stored in the high resistance coil.

The EOS switch is further stressed upon flipper deactivation, i.e. upon opening of the flipper actuation switch, "FAS", by reason that one end of this switch is clamped to the supply through diode, $D_1$, while the other end is not limited in the maximum negative voltage excursion of the common $N_s$ and $N_h$ coil connection. The series coil configuration prohibits the use of effective voltage clamping and the non-destructive transfer of stored energy. As both coils must conduct after switching, the voltage across the EOS switch can not be limited to a value below the supply voltage without affecting the response of the solenoid.

Second, the high resistance holding coil, $N_h$, although shorted during the flipper actuation cycle, nevertheless remains exposed to the changing magnetic flux generated by the low resistance coil $N_s$. This changing flux, in turn, induces a current in the shorted high resistance coil resulting in additional losses.

The present invention relates to a new dual-coil solenoid configuration particularly suited to the changing load requirements of a pin ball game flipper environment. More specifically, high and low resistance windings are oriented generally in a parallel arrangement wherein both coils are initially energized during the activation or dynamic movement phase of flipper operation. In this manner both windings are contributing to the magnetomotive force being generated to facilitate movement of the solenoid plunger and attached pin ball game flipper. Importantly, a short circuit is not required across the high resistance winding which, as noted, results in unproductive dissipation of electrical energy.

Furthermore, the parallel coils are more effective during the power stroke as the magnetomotive force produced is the sum of the individual coil forces, $N_sI_s+N_hI_h$. By contrast, the series configured solenoid produces a magnetomotive force less than the force that would be generated by the single coil alone $N_sI_s$, due to the losses associated with the shorted high resistance coil, $N_h$.

Further, the present parallel arranged flipper solenoid does not exhibit undesirable high voltage transient characteristics of the prior art series arrangement. A capacitance positioned across the EOS switch causes the current and corresponding magnetic flux field of the low resistance coil to slowly collapse which, in turn, advantageously controls the increase in potential across the EOS switch.

It is therefore an object of the present invention to provide a solenoid particularly adapted to actuate flippers of conventional pin ball games. It is a further object of the present invention that such solenoid exhibit improved efficiency over conventional series coil/resistance or coil/coil solenoids. It is a further object that the present solenoid minimize solenoid heating and, further, to extend the life and lower the cost of the switches associated therewith.

DESCRIPTION OF PREFERRED EMBODIMENT

Figure 1:
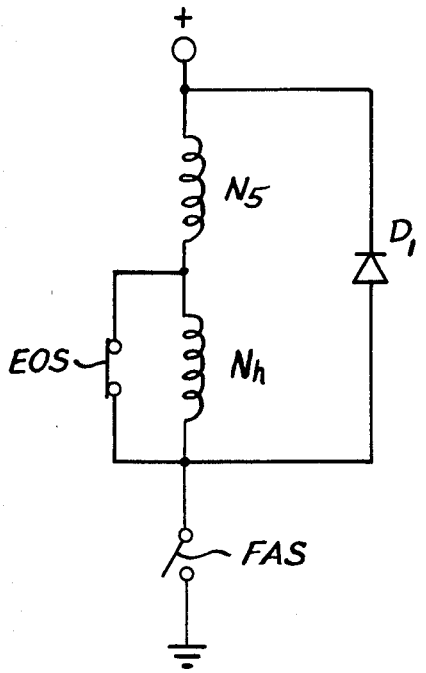
FIG. 1 PRIOR ART
FIG. 1 is a schematic representation of a prior art series configured flipper solenoid.
Figure 2:
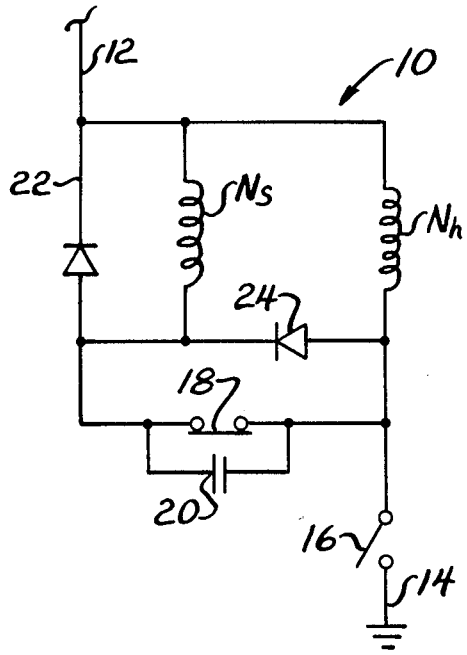
FIG. 2 is a schematic representation of the present parallel flipper solenoid.
Figure 3:
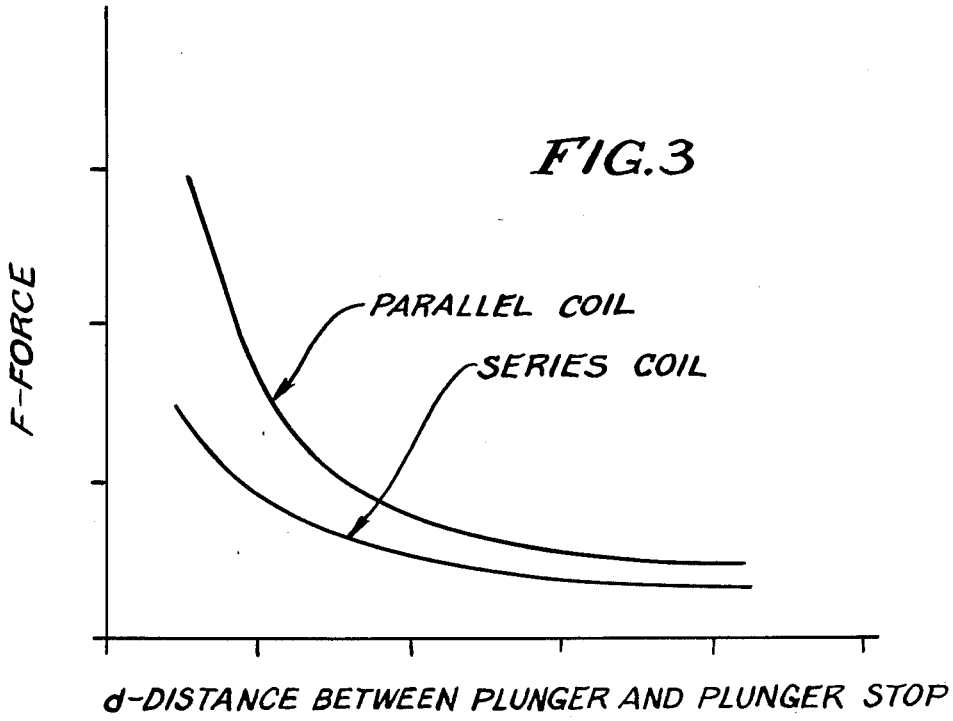
FIG. 3 is graphic comparison of the plunger forces created by the prior art and present flipper solenoids.

FIG. 2 is a schematic representation of the pin ball game solenoid actuator 10 of the present invention. Solenoid actuator 10 is powered by a dc voltage source, not shown, connected between terminals 12 and 14, respectively. This source is preferably about 50 volts with terminal 12 being positive.

A high resistance solenoid holding coil $N_h$ is connected across the dc voltage source through a normally open flipper actuation switch 16. Coil $N_h$ ranges generally between about 130 and 170 ohms depending upon the holding force desired by the game designer. Coil $N_h$ is preferably formed by winding between 3000 and 4000 turns of No. 31 AWG wire on the bobbin (FIGS. 4 and 5), as discussed in more detail below. Holding coils of 160 ohms and 4000 turns are typical.

Upon game play activation of flipper switch 16, a current of approximately 300 milliamperes will be established through holding coil $N_h$. The magnetic flux generated thereby will contribute to the force acting on the plunger during the initial movement or dynamic phase of the plunger stroke and, thereafter, this flux will constitute the sole holding force maintaining the plunger in its actuated, but static, ball-holding position.

A second or low resistance coil $N_s$ is positioned substantially in parallel across coil $N_h$. More precisely, a normally closed end-of-stroke switch 18 forms a series connection with low resistance coil $N_s$, the resulting series combination being oriented in parallel across the holding coil $N_h$. Coil $N_s$ is preferably between about 4 and 10 ohms depending upon the dynamic ball striking force desired by the game designer. The low resistance coil preferably comprises between about 875 and 1200 turns of No. 23-26 AWG wire wound on the bobbin (FIGS. 4 and 5) as discussed below. As a general rule, the lighter gage wire, e.g. No. 26AWG, is used where more turns are required. One typical solenoid comprises 1000 turns of No. 25 AWG wire thereby resulting in a low resistance winding $N_s$ of 6.5 ohms.

It will be appreciated that the low resistance coil, $N_s$, despite its fewer number of turns, nevertheless generates a substantially greater magnetic force acting on the plunger. This is due to the fact that the magnetic plunger force is a product of the current throught the coil multiplied by the number of turns comprising the coil, e.g. $N_sI_s$. Although the high resistance coil comprises 3 to 4 times more turns, it typically passes only about 1/25 the current. Consequently, the low resistance coil effectively produces between 6 and 10 times more plunger actuation force as compared with the high resistance coil. As is well known, the electrical power consumed by each coil is directly proportional to the current therethrough. Thus, a game flipper and steel ball can be maintained in the actuated, but static, position by consuming approximately 1/25 the power required to initially actuate the flipper.

As noted, end-of-stroke switch 18 is normally closed thereby resulting in the generation of a momentary current of several amperes through this coil upon game play activation of flipper switch 16. This second current, i.e. the current through coil $N_s$, creates a substantial and additional magnetic flux which adds to the flux generated by the first coil $N_h$. This combined flux produces a force sufficient to move the plunger and interconnected flipper through the dynamic power stroke and, where present, to impart to a steel game ball, an impulse necessary to propel and redirect the ball.

When the solenoid plunger and flipper have reached their nominal travel limits, end-of-stroke ("EOS") switch 18 is activated, thereby opening its switch contacts. A capacitor 20 is placed across the contacts of the EOS switch 18 to provide an alternate path, to that of switch 18, for the current flowing through coil $N_s$. In this manner, voltage transients, caused by the sudden collapse of inductive currents, are avoided. A diode 22 is positioned across coil $N_s$ to limit the maximum voltage across capacitor 20 to the supply voltage plus one diode drop (0.7 volts). A second diode 24 is oriented between the respective negative terminals of each coil $N_s$ and $N_h$, to limit the maximum voltage across switch 14, approximately 1.4 volts (i.e two diode drops) above the supply.

As will be appreciated, however, the current through coil $N_s$ quickly diminishes toward zero as that current, now diverted through capacitor 20, charges capacitor 20 to the voltage level of the dc supply. Thus, shortly following completion of the power stroke and the concomitant actuation of EOS switch 18, current remains flowing only through the holding coil $N_h$. As noted, this is the desired outcome as additional force is not required to maintain the solenoid in its actuated position.

Upon deactivation of the flipper switch 16, capacitor 20 quickly discharges through diode 22 and coil $N_h$, then through switch 18 as this switch reverts to its normally closed position. The solenoid and interconnected flipper return to their deactuated position virtually instaneously following the opening of switch 16.

Figure 4:
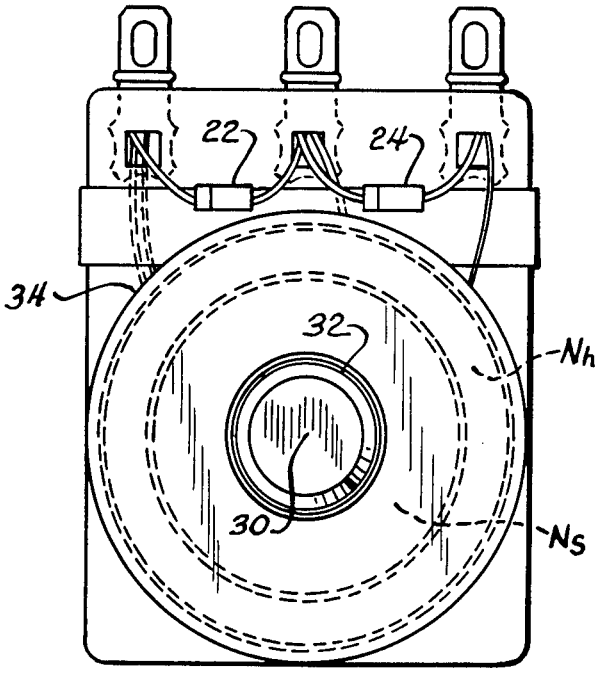
FIG. 4 is a front view of the dual-coil solenoid bobbin of the present invention looking along the axis of movement of the solenoid plunger; and, FIG. 5 is side view of the solenoid bobbin of FIG. 4.
Figure 5:
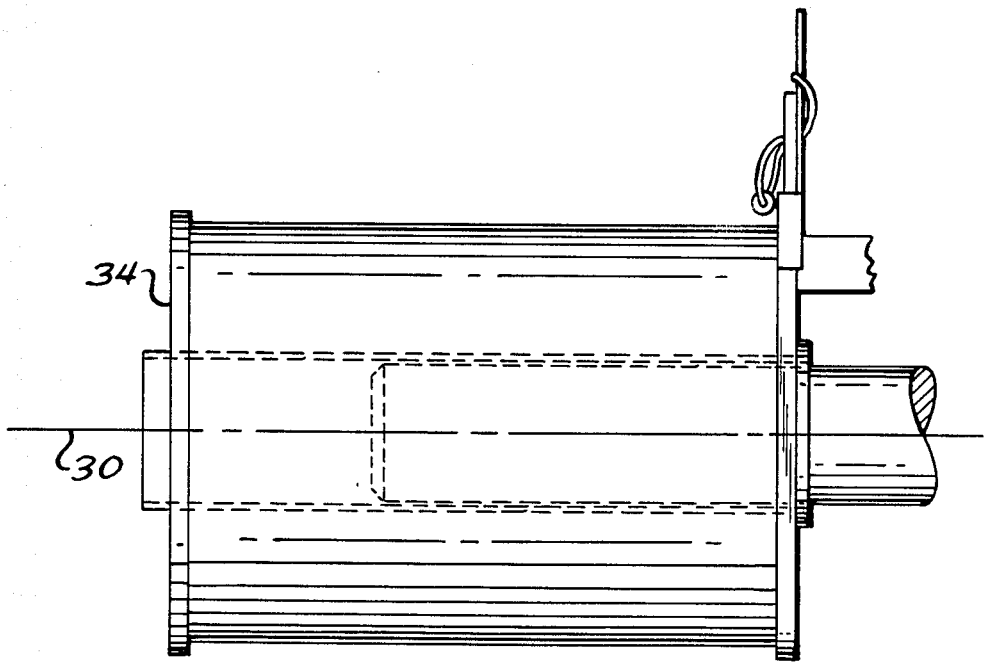

Construction of the dual-coil solenoid is best illustrated in FIGS. 4 and 5. The solenoid is of a generally conventional cylindrical construction symmetrically disposed about a central axis 30. A plunger 32, preferably 12L14 steel, is positioned for free axial movement along this axis.

Coils, $N_s$ and $N_h$, are wound on a bobbin 34 with the low resistance coil $N_s$, being wound first and closest to the plunger. In this manner, substantially all of the magnetic flux generated by the low resistance (i.e. high force) winding is constrained to pass through the plunger. The bobbin defines an axial coil length of approximately two inches and a central core, for passage of the plunger, of approximately ½ inch. The plunger is retained within the bobbin coil assembly by reason of its interconnection to the flipper assembly (not shown), the details of which form no part of the present invention. A spring (not shown) returns the plunger to its deactuated position upon the electrical opening of switch 16.

What is claimed:

1. A dual force solenoid having a first actuation force and a second holding force including a plunger disposed for movement along an axis between first deactuated and second actuated positions; a pair of windings disposed around the axis; means for applying an electrical potential in parallel across the pair of windings thereby generating the first actuation force on the plunger, said actuation force urging the plunger between the first deactuated and the second actuated positions; said means for applying an electrical potential across the pair of windings including switch diode means, operatively connected to the plunger, for disconnecting the electrical potential from one of the windings when the plunger reaches the actuated position whereby the electrical potential across the other winding generates the second holding force on the plunger, said holding force maintaining the plunger in the actuation position.

2. A dual force solenoid having a first actuation force and a second holding force including a plunger disposed for movement along an axis between first deactuated and second actuated positions; a pair of windings disposed around the axis, one of said windings having an electrical resistance greater than the other of said windings; means for applying an electrical potential in parallel across the pair of windings thereby generating the first actuation force on the plunger, said actuation force urging the plunger between the first deactuated and the second actuated positions; said means for applying an electrical potential across the pair of windings including switch diode means, operatively connected to the plunger, for disconnecting the electrical potential from the lower resistance winding when the plunger reaches the actuated position whereby the electrical potential across the higher resistance winding generates the seeond holding force on the plunger, said holding force maintaining the plunger in the actuation position.

3. The dual force solenoid of claim 2 wherein the switch means for disconnecting electrical potential from the lower resistance winding includes a normally closed single pole switch, the switch opening when the plunger reaches its second actuated position; a capacitance means across the switch for receiving energy stored in the lower resistance winding upon opening of the switch; diode means across the lower resistance winding for shunting energy from the lower resistance winding whereby the maximum potential across the lower resistance winding is limited.

4. The dual force solenoid of claim 2 wherein the switch means for disconnecting electrical potential from the lower resistance winding includes a normally closed single pole switch, the switch opening when the plunger reaches its second activated position; a capacitance means across the switch for receiving energy stored in the lower resistance winding upon opening of the switch; first diode means across the lower resistance winding for shunting energy from the lower resistance winding whereby the maximum potential across the lower resistance winding is limited; second diode means across the switch whereby the maximum potential across the high resistance winding is limited upon deactuation of the solenoid.

5. The dual solenoid of claim 2 wherein the pair of windings around the plunger and axis define two cylindrical regions, the low resistance winding comprising the first cylindrical region and the high resistance winding comprising the second cylindrical region, the first region being located radially inwardly of the second region, substantially adjacent to the plunger whereby substantially all flux generated by the low resistance winding must pass through the plunger.

* * * * *